US007236104B2

(12) United States Patent
Tran

(10) Patent No.: US 7,236,104 B2
(45) Date of Patent: Jun. 26, 2007

(54) HYBRID GROUND COLLISION AVOIDANCE SYSTEM

(75) Inventor: My Tran, Albuquerque, NM (US)

(73) Assignee: Honeywell International Inc., Morristown, NJ (US)

( * ) Notice: Subject to any disclaimer, the term of this patent is extended or adjusted under 35 U.S.C. 154(b) by 165 days.

(21) Appl. No.: 11/019,781

(22) Filed: Dec. 21, 2004

(65) Prior Publication Data

US 2006/0273929 A1 Dec. 7, 2006

Related U.S. Application Data

(63) Continuation-in-part of application No. 10/446,526, filed on May 27, 2003, now Pat. No. 6,873,269.

(51) Int. Cl.
*G08G 5/04* (2006.01)

(52) U.S. Cl. ..... 340/961; 340/963; 340/945; 701/14; 701/120; 701/301

(58) Field of Classification Search ..... 340/945, 340/961, 963; 701/14, 120, 301
See application file for complete search history.

(56) References Cited

U.S. PATENT DOCUMENTS 4,916,448 A * 4/1990 Thor ..... 340/970
5,892,462 A * 4/1999 Tran ..... 340/961
6,182,005 B1 1/2001 Pilliey et al.
6,262,697 B1 7/2001 Stephenson
6,480,120 B1 * 11/2002 Meunier ..... 340/970
6,531,978 B2 3/2003 Tran
6,584,383 B2 6/2003 Pippenger
6,646,588 B2 11/2003 Tran
6,873,269 B2 * 3/2005 Tran ..... 340/961

FOREIGN PATENT DOCUMENTS

GB 2 367 965 4/2002
WO WO 00/39775 A 7/2000

* cited by examiner

*Primary Examiner*—Jeffery Hofsass
*Assistant Examiner*—Edny Labbees
(74) *Attorney, Agent, or Firm*—Black Lowe & Graham PLLC

(57) ABSTRACT

A hybrid ground collision avoidance system (HGCAS) is a ground collision avoidance system with extended existing ground avoidance capabilities and incorporated with new hybrid capabilities to perform hybrid ground collision prediction and hybrid ground collision avoidance. This system works in collaboration with two other systems, hybrid air collision avoidance system and obstacle avoidance dispatcher and resolver module to form a bi-directional feedback network for processing and exchanging of verification and validation collision avoiding data. With the embedded hybrid prediction and avoidance processing capabilities, the system not only can refine ground collision avoidance solution to eliminate any induced air collision situation, but also provide verification for air collision avoidance resolution in the ground domain; and subsequent validate the final avoidance solution.

16 Claims, 12 Drawing Sheets

HYBRID GROUND COLLISION AVOIDANCE SYSTEM

CROSS-REFERENCE TO RELATED APPLICATIONS

This application is a continuation-in-part application of U.S. patent application Ser. No. 10/446,526 now U.S. Pat. No. 6,873,269, entitled "EMBEDDED FREE FLIGHTOBSTACLE AVOIDANCE SYSTEM", filed on May 27, 2003, the teachings of which are incorporated herein by reference

BACKGROUND OF THE INVENTION

1. Field of the Invention (Technical Field)

The present invention relates generally to the field of avionics for hybrid ground collision avoidance systems to provide a complete coverage for ground collision avoidance situations and validate air collision resolution from induced ground collision situation. More specifically, the present invention relates to a hybridized dual domain handler avoidance system for providing instantaneous real-time ground collision avoidance that will have dual domain of ground and air compatibility. The invention provides the capabilities for automatic ground avoidance re-generation with the aiding of the feedback data generated by the hybrid air collision system and verification and validation of the air collision avoidance resolution.

2. Background Art

An aircraft equipped with an embedded hybrid ground collision avoidance system (HGCAS) has the capabilities to uniquely avoid a ground collision situation without the implication of inducing an air collision. These capabilities are achieved by incorporating a dispatcher and collision resolver module. This module provides filtering of collision solution data, evaluating, and routing feedback data resulting from cross-domain verification in hybrid modules. By inserting hybrid processing capabilities, the hybrid ground collision avoidance module can predict if the solution produced by the hybrid air collision avoidance module will have a ground clearance and similarly, the hybrid air collision module can also predict if the solution produced by the hybrid ground collision module will not mis-guide the aircraft to an unsafe airspace.

The development of an effective airborne obstacle collision avoidance system (CAS) has been the goal of the aviation community for many years. Airborne obstacle collision avoidance systems provide protection from collisions with ground and other aircraft. As is well appreciated in the aviation industry, avoiding collisions with ground and other aircraft is a very important endeavor. Furthermore, collision avoidance is a problem for both military and commercial aircraft alike. Therefore, to promote the safety of air travel, systems that avoid collision with other aircraft and terrain are highly desirable.

A prior art ground collision avoidance system is described in U.S. Pat. No. 5,892,462, to Tran, entitled Adaptive Ground Collision Avoidance System, which uses a predictive flight path to estimate the flight path envelope along with the accurate terrain information to determine whether a ground collision condition exists. The resulting solution is determined from prediction calculations and provides warnings and appropriate generated maneuvers to avoid a ground collision. This solution is applied solely to a terrain elevation domain without taking the aircraft's traveling in time and in space into consideration. Without the feedback and validation of the solution from an air collision coverage domain, the avoidance solution in many instances does not have a complete free clearance for obstacle avoidance.

SUMMARY OF THE INVENTION (DISCLOSURE OF THE INVENTION)

The present invention is a hybrid ground collision avoidance system that preferably is an embedded system in an integrated mission management system (IMMS). The system is one of three main engines of an obstacle avoidance system. Each engine is designed and partitioned as a module. The obstacle avoidance management module continuously monitors the status of ground collision conditions and air collision conditions and the solutions generated by the two indicated engines. This module also serves as a filtering medium and a conduit for passing a selective collision resolution from one engine to another engine to allow a continuous evaluation and providing feedback about an "induced" collision condition on the indicated solution. If an "induced" collision is determined, the information from the evaluation is routed back to the originated solution module for re-planning to generate a more suitable avoidance solution to a complex obstacle situation. When there is no potential conflict with the provided solution, the obstacle management module will process the obstacle solution package along with the original tag to generate specific guidance data, and can include an obstacle avoidance situation display, and a synthesized audio message being specific to the situation to warn the flight crew. The second component is a hybrid ground collision avoidance engine. This engine takes into account the global air traffic management (GATM) information, terrain data, air data, radar altitude, and the check data contained in the air collision verification data to determine if there is a conflict found in the second engine in order to predict and generate a suitable solution for ground and specific air avoidance solutions. The third component is a hybrid air collision avoidance module to predict and generate a suitable solution for air and specific ground avoidance solutions.

The present invention processes navigation data, terrain data, air data and radar altitude, along with a hybrid avoidance solution generated by the Hybrid Air Collision Avoidance System to determine if there is a conflict in the ground domain. If there is a conflict, the specific information of location, avoidance maneuver path and time markers will be routed to the Hybrid Air Collision Avoidance System (HACAS). This information will allow the HACAS to verify the solution compatibility with the operating air traffic environment. If the feedback data identifies a positive incompatibility condition found in the ground solution, then the system will apply the memorized trace process with the specific feedback information to refine the avoidance solution. If the revised solution is again verified, it takes the feedback data of predicting ground collision and provides a cross-feed of collision and avoidance data produced by the two avoidance modules by implanting unique air avoidance capabilities in the hybrid terrain collision avoidance engine and unique ground avoidance capabilities in the hybrid air collision avoidance module, along with the arbitration and controlling capability in the obstacle avoidance management module, which results in producing an obstacle solution.

It is an object of the present invention to provide obstacle avoidance control guidance that is compatible with instantaneous operating air space and localized terrain and feature situations, and unambiguous warnings to any flight crew operating an aircraft. The prior art control guidance and warnings produced from a single domain system, in some instances, can create ambiguity and uncertainty to the operation of the flight crew.

It is also an object of the present invention to provide an embedded obstacle avoidance system that is capable of routing and inserting commands and status data to individual modules for a continuous validation of an avoidance resolution.

It is a further object of the present invention to provide an obstacle avoidance system, which is capable of operating simultaneously in a dual-domain mode and providing a flexible capability needed for an aircraft to operate safely and effectively in a free flight environment.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

Figure 1:
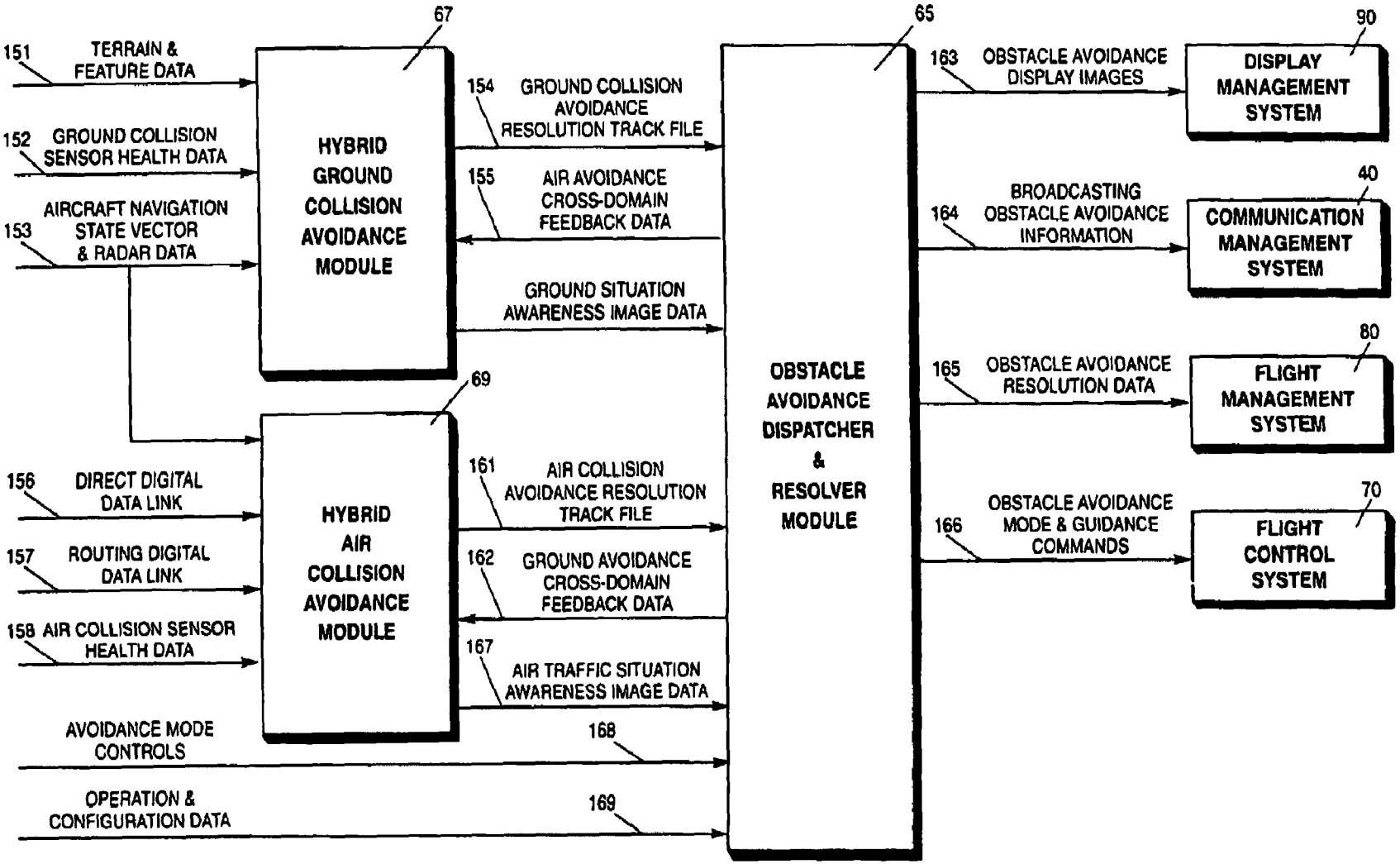
FIG. 1 is a diagram showing the modular structure of the preferred hybrid ground collision avoidance system with three collaborative system modules.

Referring to FIG. 1, there is shown a modularized structural diagram of three-hybrid embedded modules that make up the free flight obstacle avoidance system. Each module provides a set of unique functional capabilities enabling collaborative operations between the three modules. Hybrid Ground Collision Avoidance Module (HGCAM) 67 operates with three different modes, the Standby mode, the Hybrid Ground Collision Prediction (HGCP) mode and hybrid Ground Collision Avoidance (HGCA) mode. To predict the ground collision conditions on a continuous basis, HGCAM 67 relies on terrain and features data 151, ground collision sensor health data 152, and aircraft navigation state vector and radar data 153. In the HGCP mode, HGCAM 67 uses the air avoidance resolution information contained in air avoidance cross-domain feedback data 155 with the indicative inputs to determine terrain clearance conditions for an indicated air avoidance solution. HACAM 69 also operates in three modes, the Standby mode, the Hybrid Air Collision Prediction (HACP) mode, and the Hybrid Air Collision Avoidance (HACA) mode. To predict an air collision condition on a continuous basis, HACAM 67 relies on the data contained in direct digital data link 156, routing digital data link 157, air collision sensor health data 158, and aircraft navigation state vector and radar data 153. In the HACP mode, HACAM 69 uses the ground avoidance solution information contained in the ground avoidance cross-domain feedback data 162 along with the indicative inputs to determine air clearance conditions for an indicated ground avoidance solution. To achieve operational compatibility for the final obstacle avoidance solution in the dual-domains of ground and air traffic, obstacle avoidance dispatcher and resolver module (OADRM) 65 will operate based on the controls and data from avoidance mode controls 168 and operation and configuration data 169 in dispatching an avoidance solution along with the supportive data produced from one hybrid module and consumed by another hybrid module. The routing information will enable the process of cross-domain verification and validation for an avoidance solution. If an avoidance solution results in an "induced" collision condition in the verifying phase, then OADRM 65 will correlate and provide the originator module with verification feedback, air avoidance cross-domain feedback data 155 for HGCAM 67 and ground avoidance cross-domain feedback data 162 for HACAM 67. If an "induced" condition is determined, the detailed information of the "induced" condition is included in the feedback data. The originator module will use the feedback data to generate a more applicable solution, comprising either modifying the original solution or generating a new solution. OADRM 65 monitors the data contained in ground collision avoidance resolution track file 154 to determine if a predicted ground collision condition exists. If the condition exists, OADRM 65 sends a request along with the data extracted from ground collision avoidance track file 154 to HACAM 69 to perform verification for an air traffic situation. After determining air traffic situation for an indicated ground collision avoidance solution, HACAM 69 provides feedback information via air collision avoidance resolution track file 161 to OADRM 65. This module will process the feedback data and package the data to be routed back to HGCAM 67. Similarly, OADRM 65 checks for compatibility indicators in the ground collision avoidance resolution track file 154 for an air traffic avoidance resolution and then determines appropriate data to send back to HACAM 69 through ground avoidance cross-domain feedback data 162. If compatibility is obtained, OADRM 65 will overlay the obstacle data with the map data and the air traffic data to provide obstacle avoidance display images 163. The display data is then sent to display management system 90 for image rendering. The obstacle resolution along with the aircraft dynamics navigation vector are packed in broadcasted obstacle avoidance information 164 and sent to communication management system 40. OADRM 65 sets the state of the obstacle avoidance mode and feeds the control target through the obstacle guidance control laws to generate proper mode and guidance commands 166 to flight control system 70. Filtered obstacle avoidance resolution data 165 is sent to flight management system 80 for flight plan updates and informs air traffic management of impending changes to the active flight plan. Similarly, OADRM 65 monitors the data contained in air collision avoidance resolution track file 161 to determine if a predicted air collision condition exists. If the condition exists, OADRM 65 extracts the information from air collision avoidance resolution track file 161 and sends it to HGCAM 67 to perform verification via air avoidance cross-domain feedback data 155. After verifying for the comparability of the air solution in the ground domain, HGCAM 67 transmits the feedback information for the air resolution to ground collision avoidance resolution track file 154. OADRM 65 checks for air compatibility provided for the ground solution in air collision avoidance track file 161 and sends back this information to HGCAM 67 through air avoidance cross-domain feedback data 155. If compatibility is obtained, OADRM 65 will overlay the obstacle data with ground situation awareness image data 159 and send this image data to display management system 90. In addition, OADRM 65 generates obstacle avoidance mode and guidance commands 166 for flight control system 70 and sends the re-planned flight path to flight management system 80 for flight plan updates and fuel and time performance predictions. OADRM 65 also has the capability to filter, select, and tag the data provided by hybrid modules 67 and 69, prior to routing the packaged data for verification and validation in a different domain.

Figure 2:
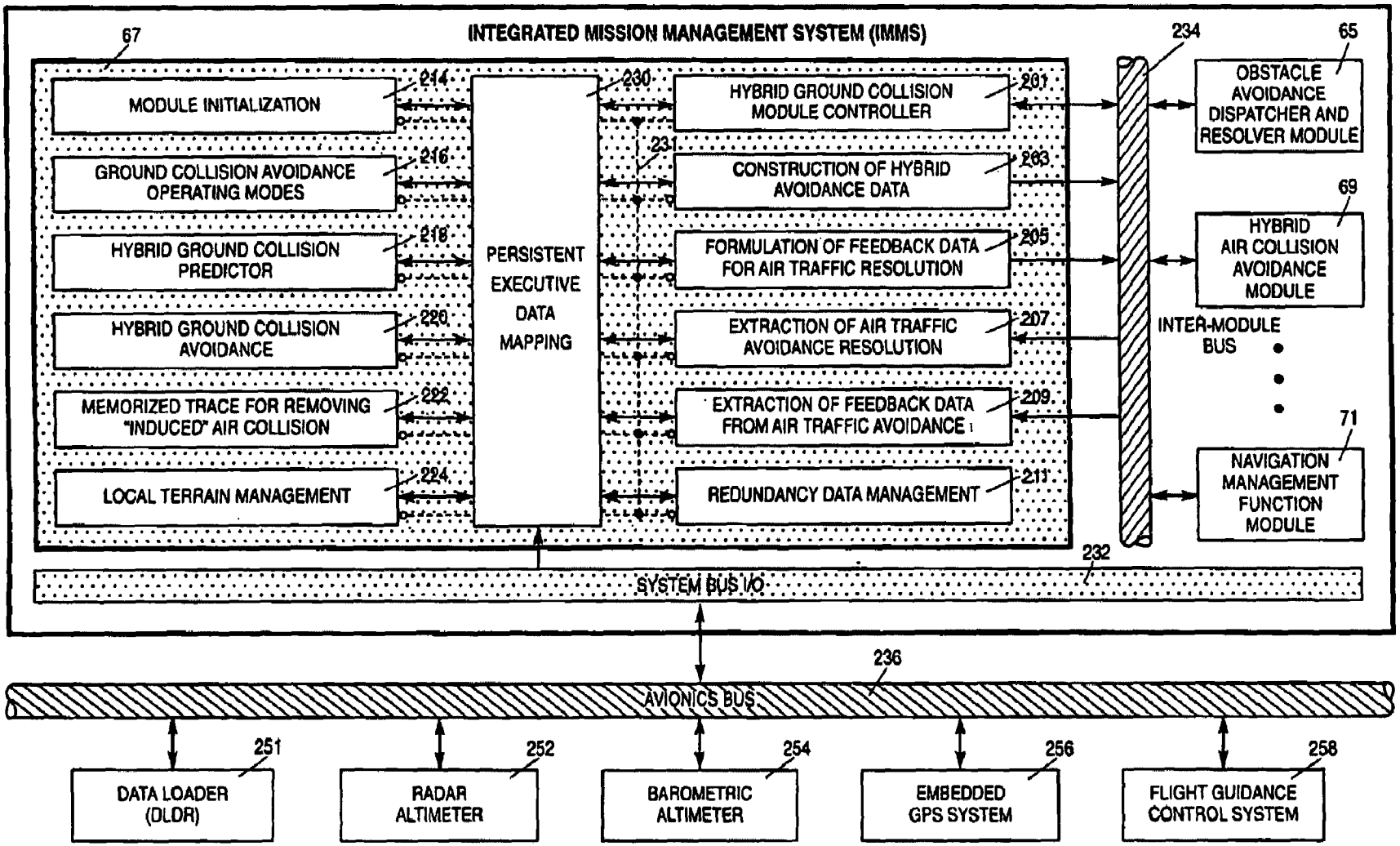
FIG. 2 is a functional block diagram showing system components and the interfaces between the Hybrid Ground Collision Avoidance System and other avionics systems, the Obstacle Avoidance Dispatcher and Resolver system, and Hybrid Air Collision Avoidance System in accordance with the present invention.

Referring to FIG. 2, there is shown a functional block diagram of HGCAS 67 from FIG. 1. HGCAS 67 preferably has a bi-directional communication means with the Obstacle Avoidance Dispatcher and Resolver Module (OADRM) 65 and the Navigation Management Function Module 71 through an intra-module bus 234. Persistent Executive Data Mapping 230 handles data transferred between internal components of HGCAS 67. External communication with other avionics systems included Data Loader (DLDR) 251, Radar Altimeter 252, Barometric Altimeter 254, Embedded Global Positioning and Inertial System (EGI) 256, and Flight Guidance Control System 258. Communication is controlled and scheduled for transmitting and receiving by System Bus Input and Output Controller 232 on avionics bus 236. HGCAS 67 is built with a set of components designed to perform the hybrid ground collision prediction function and hybrid ground collision avoidance function. The first component is a hybrid ground collision avoidance module controller 201. This component determines timing and a processing sequence of all components contained in this module and activates controls through control scheduler 231. Ground collision avoidance operating modes component 216 continuously evaluates system conditions to determine the active mode and state for the module. After completion of system power-up test, module initialization component 214 performs initialization for all working data buffers and sets the control signals to safe states. Hybrid ground collision predictor component 218 determines a ground collision condition based on correlation of an instantaneous projection of a vertical profile for the aircraft flight path and a corresponding local terrain profile. If extraction of air traffic avoidance resolution component 207 determines that there is a request to verify ground condition compatibility for an air traffic avoidance resolution, then this component will unpack and convert the provided data to a specific format needed by hybrid ground collision predictor 218. With the availability of the formatted air traffic avoidance resolution data, component 218 provides an evaluation of an air traffic avoidance solution with the local terrain situation to determine if an induced ground collision condition exists. To maintain a current operating local terrain database, local terrain management component 224 continuously monitors the aircraft position along with the ground speed vector to determine when to initiate an update to the local terrain and feature data. The updated local terrain and feature database is an important input to the processing of two components, hybrid ground collision predictor 218 and hybrid ground collision avoidance 220. The memorized trace for removing induced air collision component 222 re-establishes the process of collision avoidance, which will be used by hybrid ground collision avoidance 220 in generating a new avoidance solution. If there is an indication of an induced air collision in the feedback data, hybrid ground collision avoidance component 220 uses the memorized trace to find a new solution that will be compatible with the air traffic domain and removes the induced air collision condition. To resolve an induced air collision situation, the extraction of feedback data from air traffic avoidance component 209 unpacks the data and converts them to the format to be expected by hybrid ground collision avoidance 220. If there is a ground collision condition and hybrid ground collision avoidance component 220 completes the generation of the ground collision avoidance solution, the construction of hybrid avoidance data component 203 takes the output data produced by hybrid ground collision predictor 218 and hybrid ground collision avoidance 220 to form a hybrid data package of a ground avoidance solution. This package is sent to OADRM 65 and subsequently, the data in this package is processed by the HACAS 69 to verify air traffic domain compatibility. For the feedback of an air traffic collision avoidance solution, formulation of feedback data for air traffic resolution 205 will collect verification data produced in ground collision avoidance operating modes component 216 along with the suggested solution produced by hybrid ground collision avoidance 220 into a hybrid data package. The data is then transmitted to OADRM 65. Extraction of feedback data from air traffic avoidance component 209 processes the feedback data to determine if the generated ground solution is compatible with the local air traffic. If there is an induced air collision condition, the memorized trace for removing induced air collision component 222 takes into consideration the air collision information, such as a predicted collision point and time along with a memorized traced flight path to generate a new ground avoidance solution. Redundancy data management component 211 selects the appropriate sensor data to be used by other components to determine a mode of operation, ground collision prediction, and ground collision avoidance solution generation.

Figure 3:
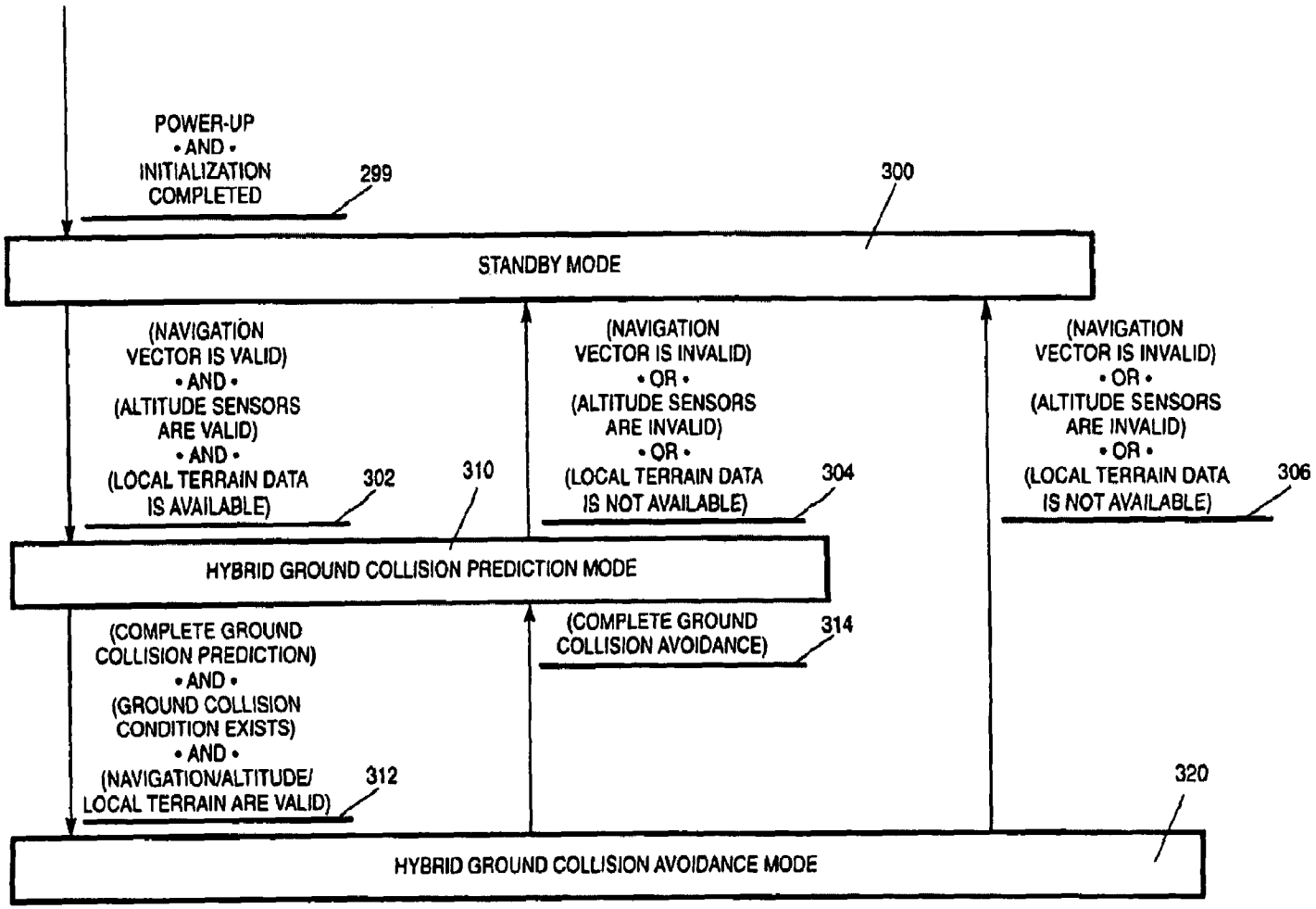
FIG. 3 is a mode transition diagram for three modes of the Hybrid Ground Collision Avoidance System in accordance with the present invention.

Referring to FIG. 3, there is shown a state transition diagram providing necessary logic to allow a mode transition to take place. The three system modes of HGCAS 67 are: standby mode 300, hybrid ground collision prediction mode 310, and hybrid ground collision avoidance mode 320. At system power-up, after completing system power-up test and initialization 299, HGCAS 67 is placed in standby mode 300. From standby mode 300, if the data in navigation vector is valid, the altitude sensor is valid, and local terrain data is available 302, the module will make a transition to hybrid ground collision avoidance mode 320. Also from hybrid ground collision prediction mode 310, the module will make a transition back to standby mode 300, if either the navigation vector is invalid, or the altitude sensors are invalid, or local terrain is not available 304. From hybrid ground collision avoidance mode 320, the module will make a transition back to hybrid ground collision prediction mode 310, if the ground collision avoidance flag is set to true 314. From hybrid ground collision avoidance mode 320, the module will make a transition to standby mode 300 if either the navigation vector is invalid, or altitude sensors are invalid, or local terrain is not available 306.

Figure 4:
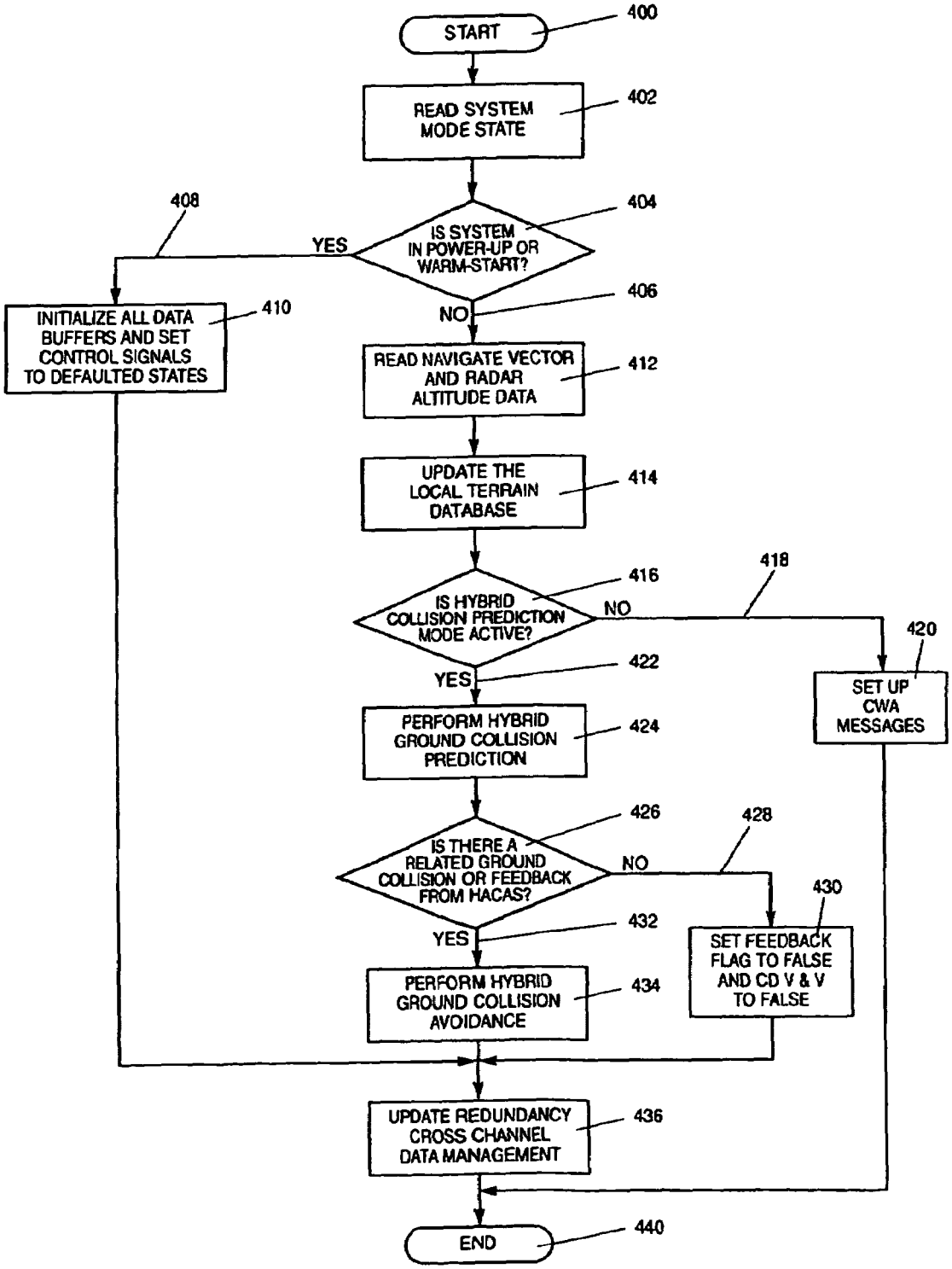
FIG. 4 is a logical flow diagram showing system behaviors of the Hybrid Ground Collision Avoidance system in accordance with the present invention.

Referring to FIG. 4, there is shown a flow diagram outlining system behaviors of the HGCAS 67. The initial step is start 400. The module reads system mode state 402. A test is then performed to determine if the module is in power-up or warm start 404. If the answer is affirmative 408, the module performs data initialization and sets control signals to defaulted states 410. Otherwise, the module will proceed with step 406 to read navigation vector and radar altitude data 412. The module will then update the local terrain and feature data based on current platform position and ground speed vector provided in navigation vector 414. A test is made to determine if hybrid collision prediction mode is active 416. If hybrid collision prediction mode is not active 418, the module will set up caution, warning and advisory messages 420. If an affirmative determination 422 is made, then the module will perform hybrid ground collision prediction 424. A test is made to determine if there is a related ground collision condition or a feedback from HACAS 426. If there is no affirmative determination 428 for this test, then the module will set the feedback flag to false and cross-domain (CD) verification and validation to false 430. If there is an affirmative determination 432 for this test, then the module will perform hybrid ground collision avoidance 434. After processing step 434, the module will update redundancy cross channel data management 436 and then go to the end of process flow 440 waiting for a next processing cycle to repeat the entire process from step 400.

Figure 5A:
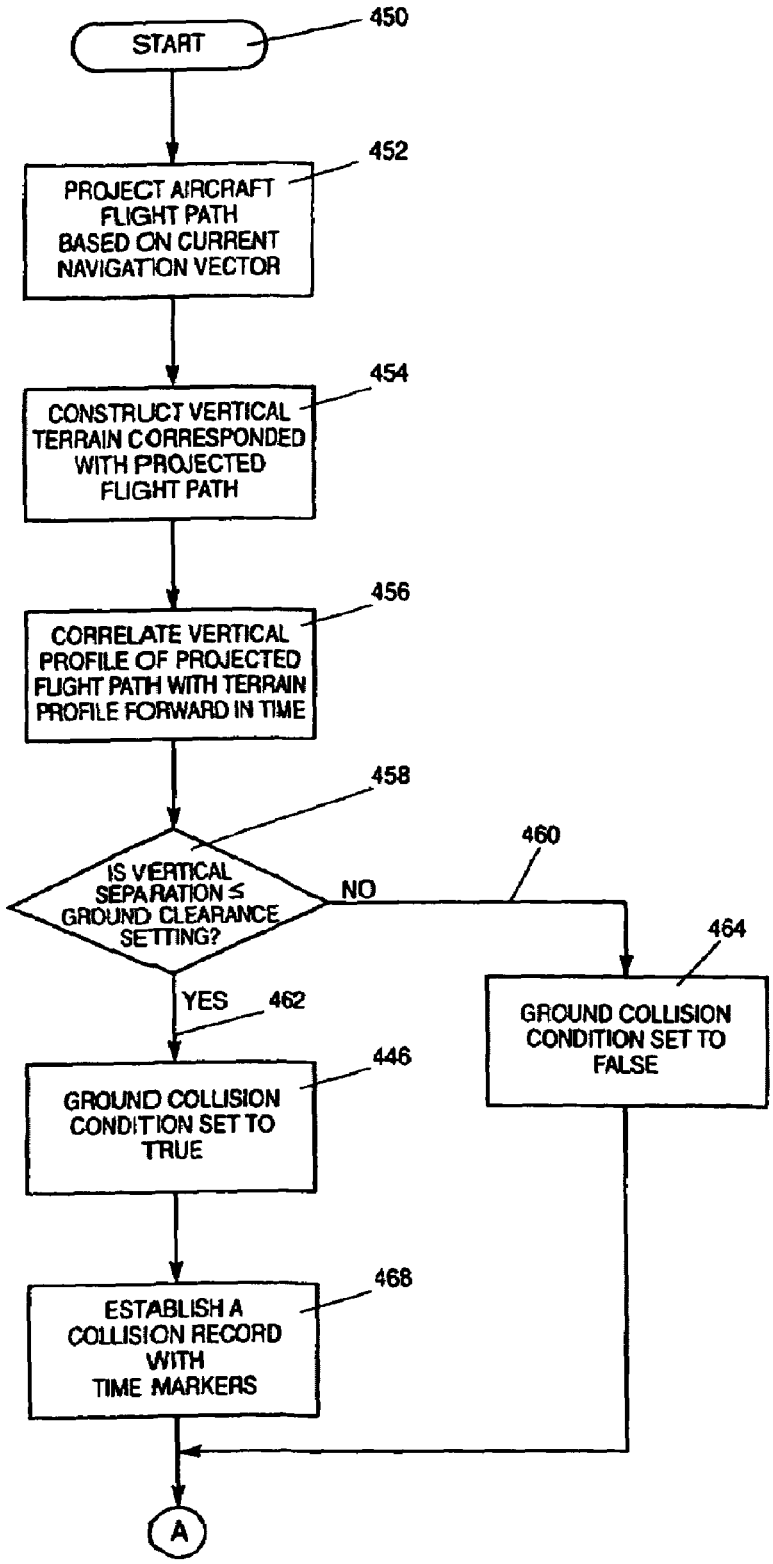
FIG. 5*a* and FIG. 5*b* are logical flow diagrams outlining the behavior of the Hybrid Ground Collision Predictor process in accordance with the present invention.

Referring to FIG. 5*a*, there is shown a flow diagram outlining the process steps of hybrid ground collision predictor 218. The initial step is start 450. The module performs a projection of the aircraft flight path based on current navigation vector 452. With the computed aircraft flight path and the local terrain and feature database, the module constructs a vertical terrain profile 454. The module will then correlate the vertical profile of the projected flight path with the constructed vertical terrain profile forward in time to determine vertical separation 456. This test for vertical separation against ground clearance setting is made in step 458. If the vertical separation is not equal to or less than the threshold of ground clearance setting 460, then the module sets the flag of ground collision condition to false 464. If there is an affirmative determination 462 for this test, then the module will set the flag of ground collision condition to true 446. The next step, the module builds a collision record with an inclusion of time markers 468 and then goes to node A.

Figure 5B:
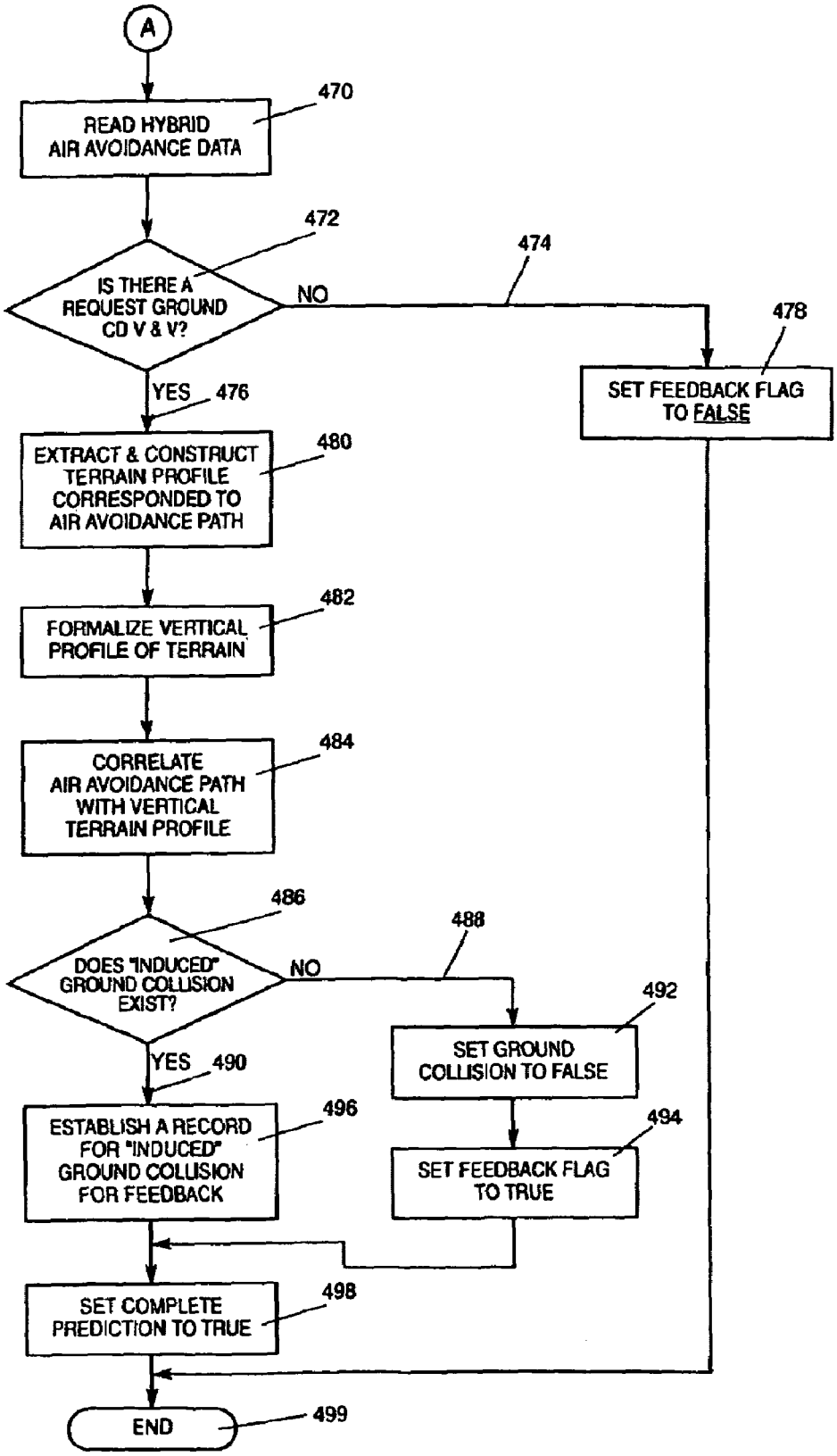

Referring to FIG. 5*b*, with a continuation from node A, the module reads hybrid air avoidance data 470. Test 472 determines if there is a request for the hybrid ground collision avoidance to perform a ground domain verification and validation for the air collision avoidance solution. If the request for cross-domain verification and validation is not set 474, the module will set the feedback flag to false 478. If there is an affirmative determination 476 for the test, the module will extract the flight path data from air avoidance solution and then construct a vertical terrain profile for the indicative flight path 480. The next step for the module is to normalize the vertical terrain profile 482. In step 484, the module correlates the vertical profile of an air avoidance path with normalized terrain profile. From the results of the vertical path correlation, the module performs a test to determine if an induced ground collision exists in the resolution of air collision 486. If there is no induced ground collision 488, the module will set the induced ground collision flag to false 492 and then set the feedback flag to true 494. If there is an affirmative determination from test 490, the module will establish a record for induced ground collision for feedback 496. The step following the processing in either step 496 or step 494 is to set the complete prediction flag to true 498 and then terminate at end 499.

Figure 6:
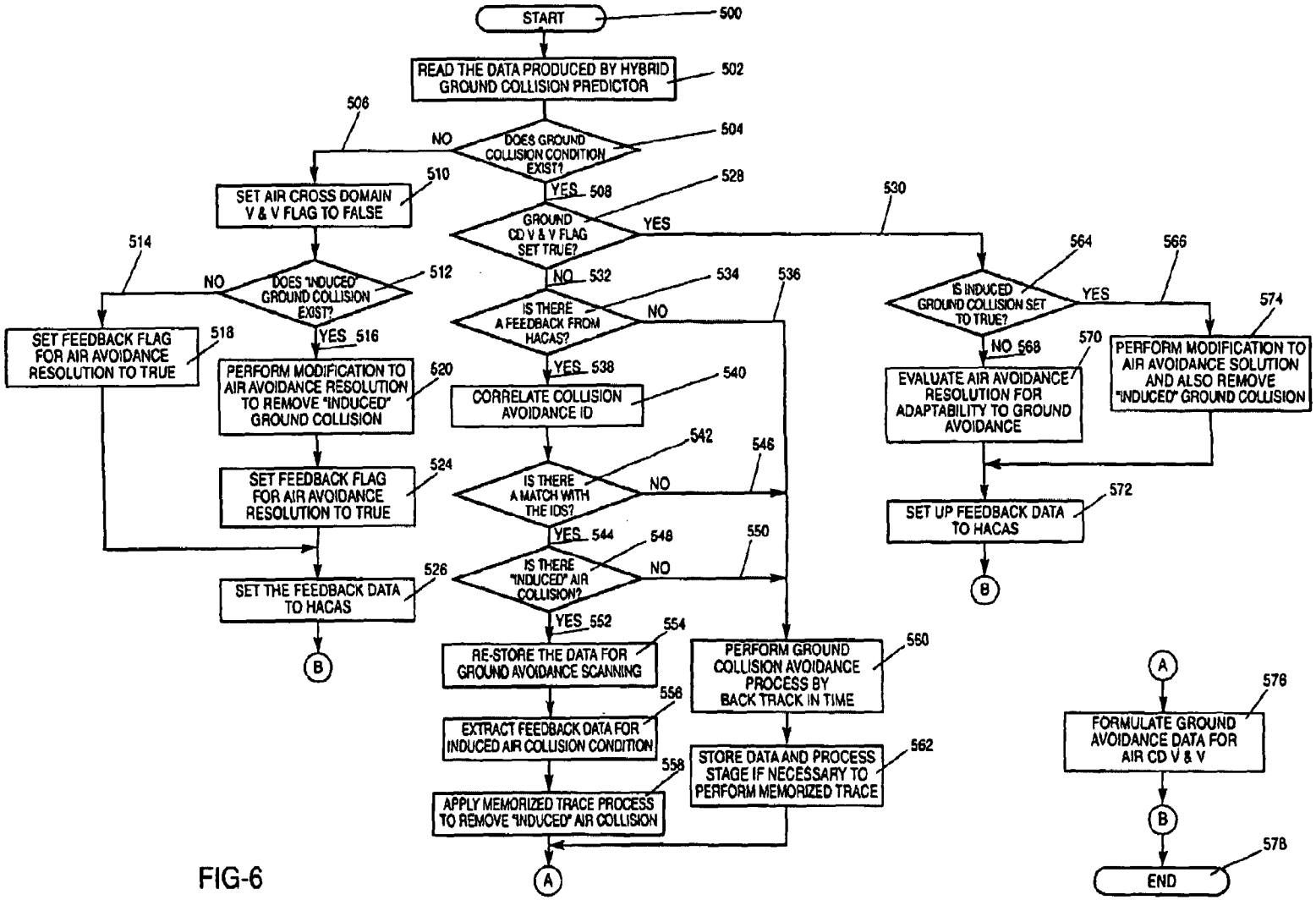
FIG. 6 is a logical flow diagram outlining the behavior of the Hybrid Ground Collision Avoidance process in accordance with the present invention.

Referring to FIG. 6, there is shown a flow diagram outlining the preferred hybrid ground collision avoidance process. The initial step is start 500. The module reads the data produced by hybrid ground collision predictor 502. A test is made to determine if a ground collision condition exists 504. If a ground collision condition doesn't exist 506, the module sets the cross-domain air verification and validation flag to false 510. A test is made to determine if an induced ground collision condition exists 512. If an induced ground collision condition does not exist 514, the module sets the feedback flag for air avoidance solution to true 518. If an affirmative determination 516 is made, the module initiates a process of modifying the air avoidance resolution to remove induced ground collision condition 520. In step 524, the module sets feedback flag for air avoidance resolution to true. Following either step 518 or step 524, the module sets up the feedback data to send to HACAS 526. The end of this step is connected to node B. Returning to test 504, if an affirmative determination 508 can be made, the module will perform another test 528 to determine if the cross-domain ground verification and validation flag is set to true 530. If it is set to true 530, the module initiates another test to determine if the induced ground collision flag is set true 564. If it is set to true 566, the module performs a modification to the air avoidance solution in order to remove induced ground collision 574. If the result from the test is negative 568, the module evaluates the air avoidance resolution for adaptability to ground avoidance 570. At the end of processing in either 570 or 574, the module sends the feedback data to HACAS 572. The module makes a connection to node B. If the cross-domain ground verification and validation flag is not set to true 532, the module makes a test to determine if there is feedback data from HACAS 534. If there is no feedback data from HACAS 536, the module will then perform ground collision avoidance process by back tracking in time 560. The module stores data and process stages in the event that it is necessary to perform memorized trace 562. The module then connects with node A. If an affirmative determination 538 can be made, the module will correlate collision avoidance identification 540. A test is made to determine if there is match for avoidance identification 542. If there is not a match 546, the module performs ground collision avoidance process by back tracking in time 560. If there is a match in collision identification 544, the module initiates another test to determine if there is an induced air collision condition 548. If the test is negative 550, the module moves to step 560. If an affirmative determination 552 is made, the module re-stores the data for ground avoidance scanning 554. The next step for the module is to extract feedback data associated with induced air collision condition 556. The module applies a memorized trace process to remove induced air collision condition 558. The module connects to node A. From node A, the module formulates the ground avoidance data for cross-domain air verification and validation 576. The module completes the execution for this process at end 578.

Figure 7:
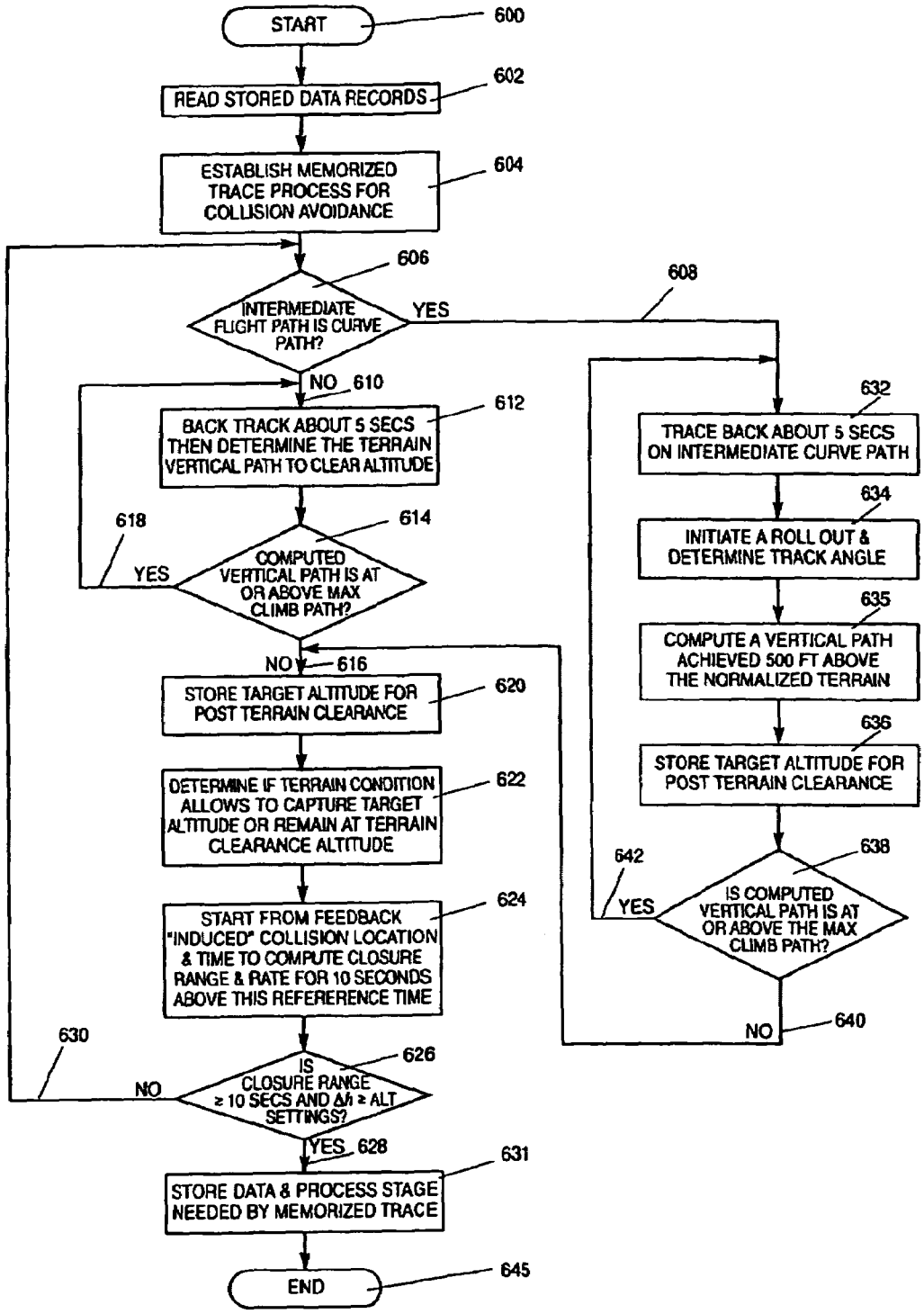
FIG. 7 is a logical flow diagram showing the functionality of the Memorized Trace process used to remove an induced air collision from a ground avoidance solution.

Referring to FIG. 7, there is shown a flow diagram outlining the memorized trace process used to remove induced an air collision condition from the ground collision avoidance solution. The initial step is start 600. The module reads stored data records 602. The module establishes memorized trace process for collision avoidance 604. The module performs a test to determine whether intermediate flight path is a curved path 606. If the flight path is a curve path 608, the module preferably initiates a trace back about 5 seconds on an intermediate curve path 632. The module initiates a roll out and computes track angle 634. The module computes a vertical path achieved above the normalized terrain elevation 635. In this example, five hundred feet is appropriate, however different distances can be used. The module stores a target altitude for post terrain clearance 636. A test is performed to determine if the computed vertical path is at or above the maximum climb path 638. If an affirmative determination 642 is made, the process will repeat the computation process, beginning with step 632. If the result of the test is negative 640, the module will continue with step 620 and beyond. If the result of the test 606 is negative 610, the module will backtrack about 5 seconds and then compute the terrain vertical path to clearance altitude 612. A test is made to determine if the computed vertical path is at or above maximum climb path 614. If an affirmative determination 618 is made, the module will go back to step 610 and process functional block 612 until the result in the test of the computed vertical path is below maximum climb path 616. The module will then store target altitude for post terrain clearance 620. The module will evaluate if the terrain condition allows the aircraft to capture a target altitude or remain at terrain clearance altitude 622. Otherwise, the module will calculate the clearance altitude. Starting from the feedback induced location and the marked time, the module performs the calculation for closure range and range rate 624. A test for closure range and altitude separation 626 is performed to determine if the closure range is equal to or greater than 10 seconds and altitude separation is at or above altitude setting, for example. If the closure range is less than 10 seconds or altitude separation is less than altitude setting 630, the module will go back the step 606. If an affirmative determination 628 is determined, the module stores the data and process stages needed by the memorized trace 631. The next step is for the module to process the end 645 to complete the memorized trace process.

Figure 8:
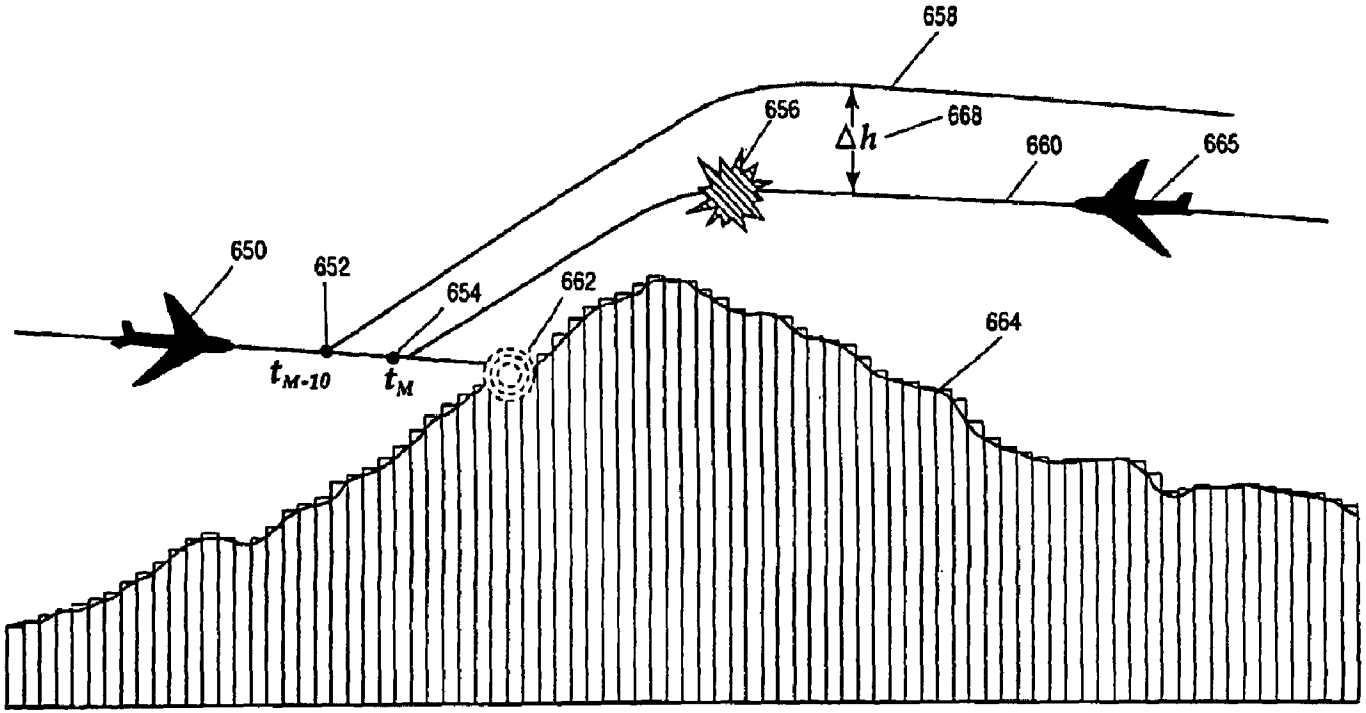
FIG. 8 is a graphical view of a vertical scanning profile using a Memorized Trace process to re-plan the intermediate flight path in order to avoid an induced air collision with an intruder aircraft in accordance with the present invention.

Referring to FIG. 8, there is shown a graphical view of a vertical scanning profile using the memorized trace process. If aircraft 650 initiates a climb-out at time $t_M$ to avoid a predicted ground condition at 662 on terrain extracted vertical terrain profile 664, the hybrid air collision predictor will provide a feedback to indicate that there is an induced air collision condition at 656. The module will then use the memorized trace process to determine the scenario whether at time $T_{M-10}$ the aircraft will initiate a climb-out 652. The difference between newly computed flight path 658 and flight path 660 of the intruder 665 provides a delta altitude 668. If the vertical separation is at or above the minimum vertical separation, the HGCAS 67 will provide the information of the new ground collision avoidance solution to HACAS 69 for validation of this solution.

Figure 9:
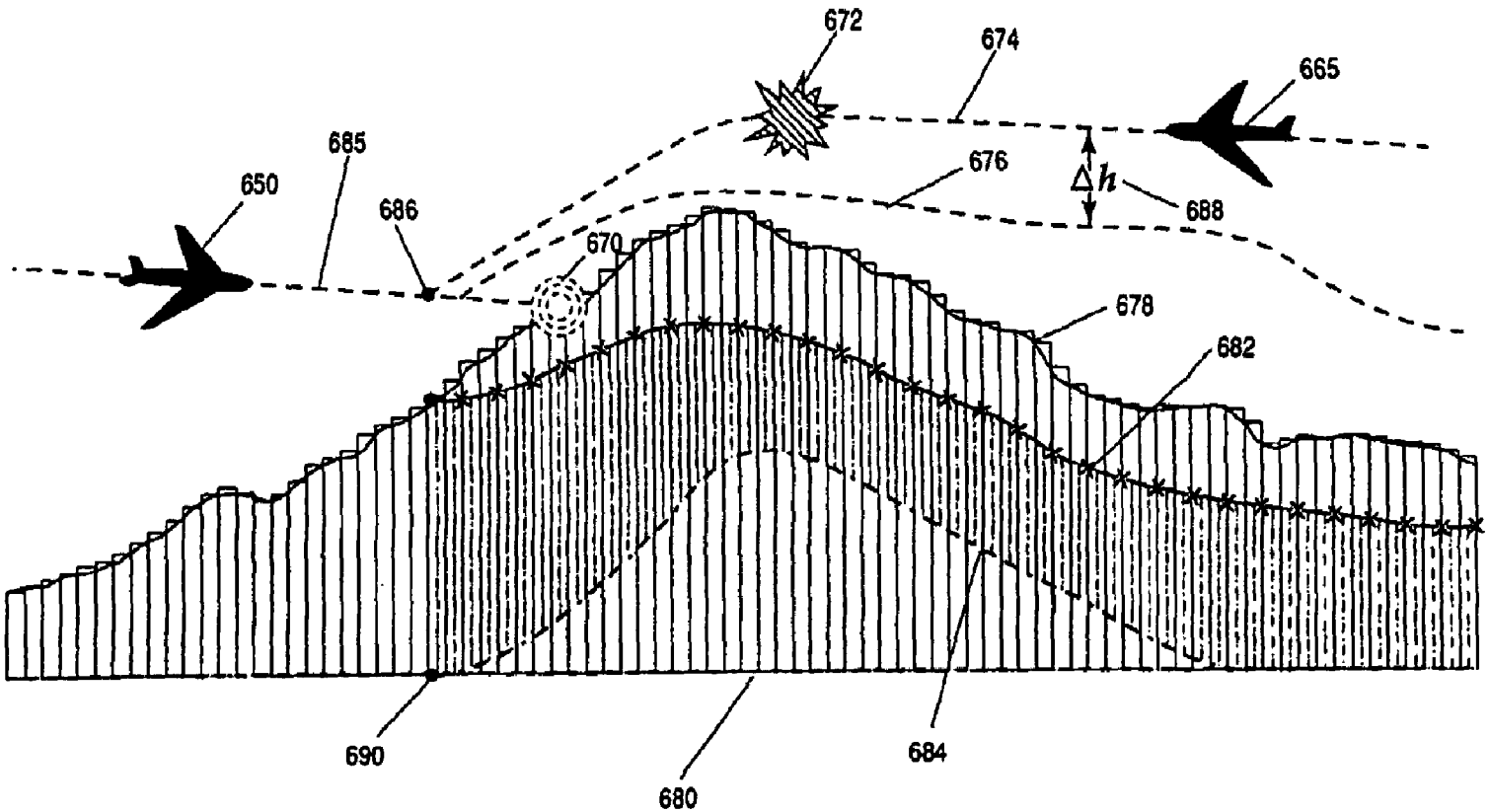
FIG. 9 is a graphical view of a combined vertical scanning and lateral projection view as a result of applying the Memorized Trace process to remove an "induced" air collision situation in accordance with the present invention.

Referring to FIG. 9, there is shown a graphical view of a vertical and lateral scanning profile using a memorized trace process. If aircraft 650 takes flight path 685, the HGCAS will predict ground collision condition 670 on vertical profile 678. The initial solution for the aircraft is to perform a climb-out at 686. However, the HACAS provides a feedback for this solution with an indication that with the ground avoidance path, hosted aircraft 650 will be placed on the air collision path with intruder aircraft 665 at initial location 672 on the intruder flight path 674. The module uses the memorized trace process to determine if there is sufficient time for back tracking. The module will initiate a right turn at initial turn point 690. This lateral path is corresponded to vertical profile 682. With the climb-out and left turn prediction, the aircraft with predicted flight path 676 will not only avoid the ground collision condition, but also achieve the constraint of vertical separation 688. Original lateral path 680 is corresponded to original vertical profile 678. Re-planned lateral path 684 is corresponded to the re-planned vertical profile 682. If the newly generated solution for ground collision avoidance can be verified for removing an induced air collision condition from HACAS, the most recent predicted fight path will be the ground avoidance solution for indicated ground situation.

Figure 10:
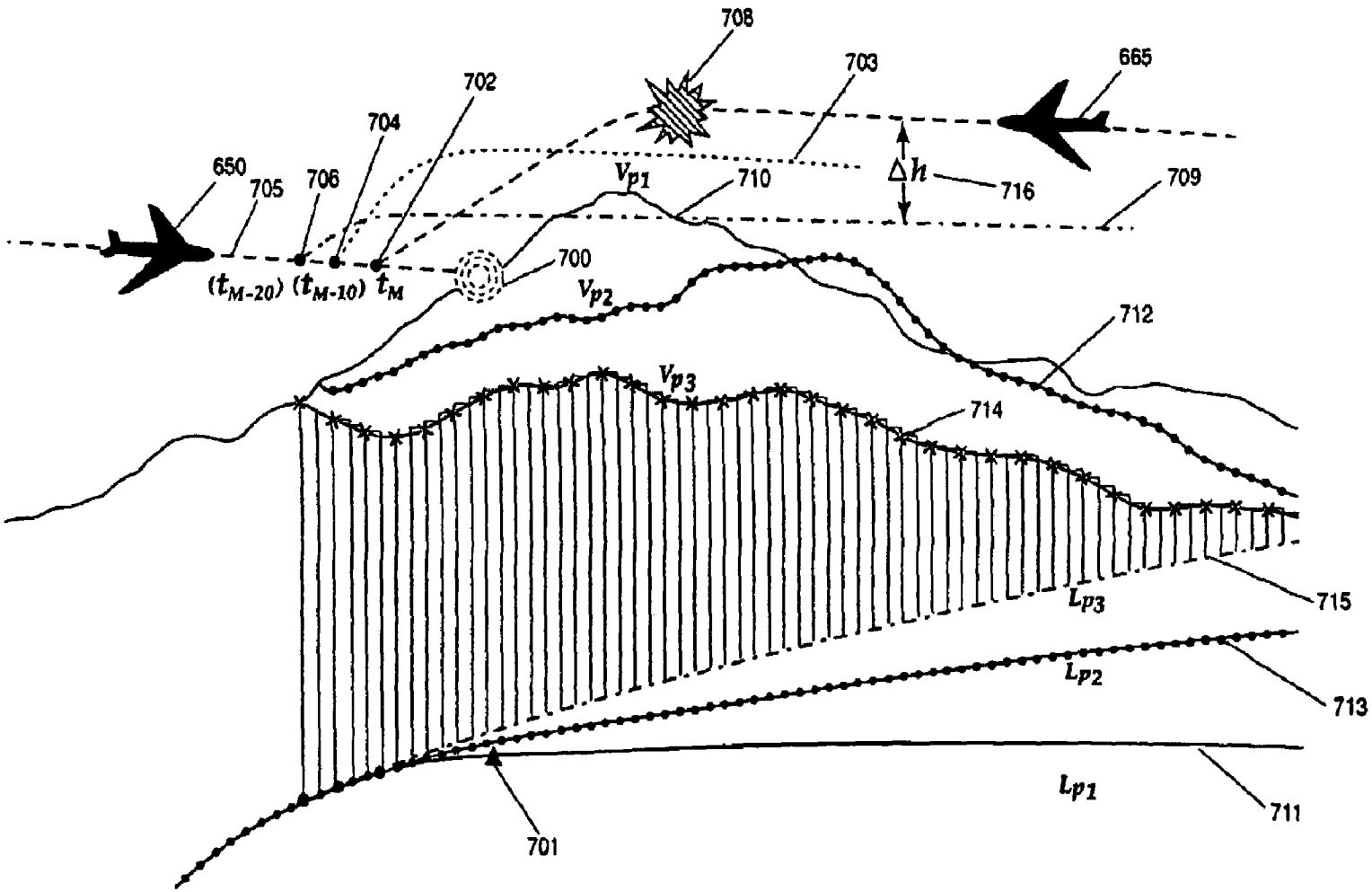
FIG. 10 is graphical view of a combined vertical scanning and re-planning lateral profile using the Memorized Trace process to remove an induced air collision situation in accordance with the present invention.

Referring to FIG. 10, there is shown a graphical view of vertical profiles corresponded with lateral profiles using the memorized trace process for a curved path. If aircraft 650 follows flight path 705 projected by the HGCAS, aircraft 650 is predicted to be on a collision path with original vertical terrain profile 710 at location 700. The position of the collision point on the original lateral path 711 is denoted 701. The HGCAS generates an initial ground avoidance path with a designated rollout and climb location 702 at the predicted time, $t_M$. The ground collision avoidance solution data is processed and sent to the HACAS for verification and validation. In this process, the HACAS generates feedback data and sends it back to HGCAS, indicating an induced air collision condition as shown in air space location 708. With this information, the HGCAS applies the memorized trace process for in-flight re-planning. At time $t_{M-10}$, the module determines the scenario if the aircraft initiates a roll-out and climb, it will be able to avoid the ground situation, but not have sufficient altitude separation to completely avoid a midair collision condition as shown in flight path 703. Vertical terrain profile 712 and corresponded re-planned lateral profile 713 at time $t_{M-10}$ and are the results of the prediction for the maneuvers at time $t_{M-10}$. The module then determines the ground and air condition for the maneuvers at time $t_{M-20}$. With the maneuvers at 706, the module determines that predicted flight path 709 will have a ground clearance as well as achieving a desirable altitude separation 716 with intruder aircraft 665. Re-planned vertical terrain profile 714 and corresponded re-planned lateral profile 715 at time $t_{M-20}$ are the results of the prediction for the maneuvers at time $t_{M-20}$. This new solution is sent to HACAS for validation.

Figure 11:
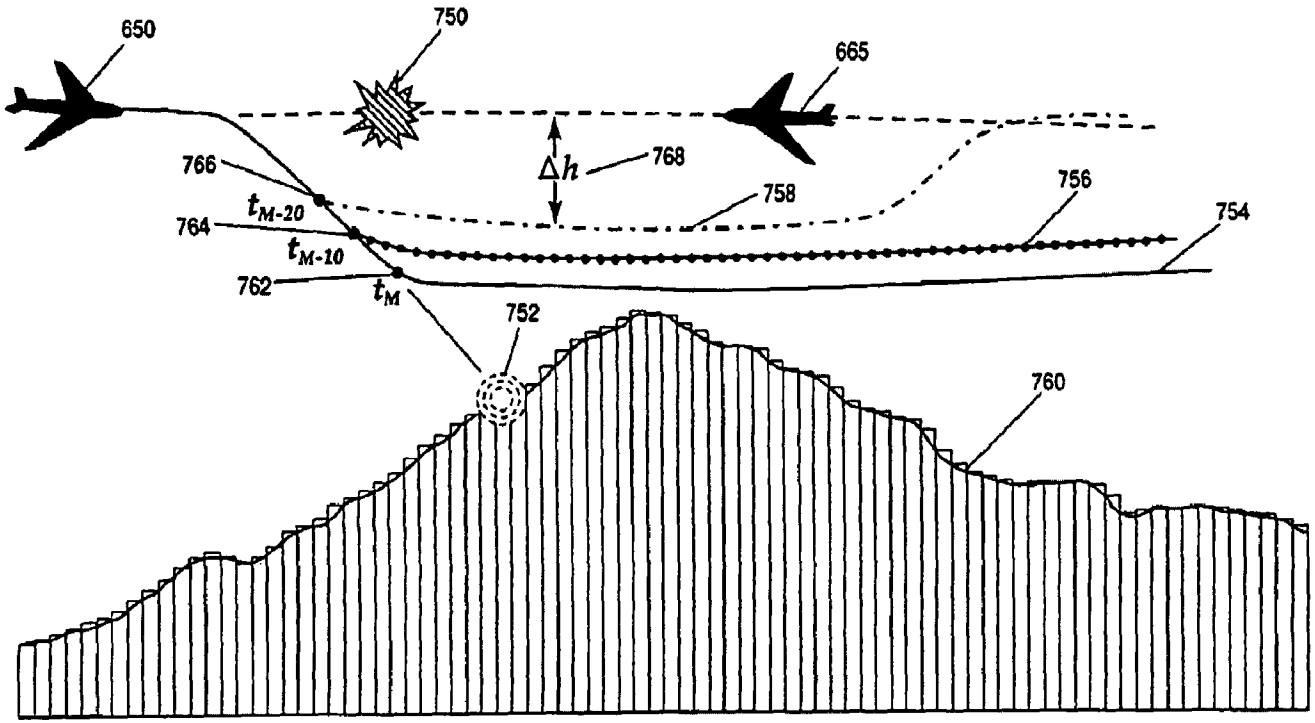
FIG. 11 is a graphical view of a correlating air collision avoidance profile with a projected vertical local terrain profile in accordance with the present invention.

Referring to FIG. 11, there is shown a graphical view in correlating an air avoidance profile with the local terrain. The solution provided by the HACAS for aircraft 650 to avoid midair collision situation at 750 is to initiate a descent. The HGCAS performs prediction calculations by correlating with projected vertical local terrain 760 and determines that, with this maneuver, the aircraft will create an induced ground collision condition at 752. The module uses the back tracking method to determine when the aircraft needs to capture a new target altitude. This provides a way to remove the induced ground condition still having sufficient altitude separation 768 from intruder aircraft 665. At time $t_M$ and $t_{M-10}$, recovery flight paths 754 and 756 do not provide sufficient terrain clearance. However, in this case, the recovery flight path at $t_{M-20}$ does have safety clearance as well as sufficient altitude separation to avoid an indicative midair collision condition. The verified data from the HGCAS will be packaged and sent to the HACAS in the form of feedback data. With this data, the HACAS will be able to refine its midair avoidance resolution.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

The invention claimed is:

1. A method for providing a hybridized ground collision avoidance solution for an aircraft, the method comprising the steps of:

a) determining whether a ground collision condition exists;

b) generating a ground avoidance solution based on the ground collision condition;

c) providing the generated ground avoidance solution to an air collision avoidance system;

d) validating the generated ground avoidance solution and generating an induced air collision condition by the air collision avoidance system;

e) providing feedback from the air collision avoidance system with the induced air collision condition to the ground collision avoidance system; and f) providing the hybridized ground collision avoidance solution.

2. The method of claim 1 wherein the ground collision condition and the induced air collision condition are dissimilar, further comprising the steps of:

establishing a memorized trace process comprising a predicted flight path, predicted avoidance maneuvers, predicted closure range and altitude separation between a predicted altitude of the aircraft and an altitude of an intruder aircraft;

providing a new generated ground avoidance solution in place of the generated ground avoidance solution to an air collision avoidance system in step c); and repeating steps d), e) and f).

3. The method of claim 2 wherein the step of providing a memorized trace process comprises storing input data.

4. The method of claim 1 further comprising the step of verifying and validating an induced ground collision condition from the hybrid ground collision avoidance system and providing feedback of the induced ground collision condition to the air collision avoidance system.

5. The method of claim 1 wherein the step of validating comprises verifying a compatibility of the generated ground avoidance solution and the induced air collision condition.

6. The method of claim 1 wherein the step of determining a ground collision condition comprises providing data from sensors, local feature and terrain data, and induced air collision feedback data.

7. The method of claim 1 wherein the step of providing a hybridized ground collision avoidance solution comprises filtering and extracting ground collision solution data.

8. The method of claim 1 wherein the step of providing a hybridized ground collision avoidance solution comprises filtering and extracting air collision data.

9. An apparatus for providing a hybridized ground collision avoidance solution for an aircraft, the method comprising the steps of:

a hybrid ground collision predictor for determining whether a ground collision condition exists and for generating a ground avoidance solution based on the ground collision condition;

a hybrid air collision avoidance system for validating the generated ground avoidance solution and generating an induced air collision condition by the hybrid air collision avoidance system;

a feedback loop for providing feedback from the air collision avoidance system with the induced air collision condition to the hybrid ground collision avoidance system; and an output for providing the hybridized ground collision avoidance solution.

10. The apparatus of claim 9, further comprising:

a means for providing a memorized trace process using data from a predicted flight path, predicted avoidance maneuvers, predicted closure ramge and altitude separation between a predicted altitude of the aircraft and an altitude of an intruder aircraft wherein a new generated ground avoidance solution is determined and is a new input to the hybrid ground collision predictor in place of the generated ground avoidance solution.

11. The apparatus of claim 10 wherein the means for providing a memorized trace process comprises a storage structure for storing input data.

12. The apparatus of claim 9 further comprising a means for verifying and validating data for the induced ground collision and providing a feedback loop between the induced ground collision condition and the air collision avoidance system.

13. The apparatus of claim 9 wherein the hybrid air collision avoidance system further comprises a means for verifying a compatibility of the generated ground avoidance solution and the induced air collision condition.

14. The apparatus of claim 9 wherein the hybrid ground collision predictor comprises data from sensors, local feature and terrain data.

15. The apparatus of claim 9 wherein the output for providing the hybridized ground collision avoidance solution comprises filters and extractors for ground collision solution data.

16. The apparatus of claim 9 wherein the output for providing a hybridized ground collision avoidance solution comprises filters and extractors for air collision data.

* * * * *